United States Patent [19]

Ellis

[11] Patent Number: 4,821,162

[45] Date of Patent: Apr. 11, 1989

[54] LIGHTING ASSEMBLY

[76] Inventor: Peter J. Ellis, 5-7 Manning Street, Rozelle, New South Wales, Australia

[21] Appl. No.: 193,777

[22] Filed: May 13, 1988

[30] Foreign Application Priority Data

May 13, 1987 [AU] Australia ..... 72760/87

[51] Int. Cl.[4] ..... F21S 1/04

[52] U.S. Cl. ..... 362/408; 362/147; 362/371; 362/430; 439/110

[58] Field of Search ..... 362/147, 404, 407, 408, 362/430, 270, 285, 287, 370, 371; 439/110

[56] References Cited

U.S. PATENT DOCUMENTS 4,414,617 11/1983 Galindo ..... 362/404

4,591,764 5/1986 Nilssen ..... 362/404 X

*Primary Examiner*—Stephen F. Husar

*Attorney, Agent, or Firm*—Nixon & Vanderhye

[57] ABSTRACT

A low voltage lighting assembly which comprises a lamp holder, a pair of rigid electrically conductive arms, each arm having a lower end that passes through opposingly disposed apertures in the lamp holder in a manner so as to maintain electrical contact with a lamp socket disposed within the lamp holder, while said lamp holder is pivotable about the axis of the lower arms, each arm having an upper end with means to permit independent movement of an arm along one of a pair of spaced apart elongate electrical conductors and to be fixed in place to form electrical contact therewith. The conductors have means to connect to a suitable source of electric current, at a voltage of no more than about 24V. By pivoting the lamp holder about the axis of the lower arm ends, and moving each of the upper arm ends along the conductors, a lamp mounted in the holder may be positioned transversely with respect to the axis lying through the lower ends and longitudinally with respect to the conductors.

6 Claims, 2 Drawing Sheets

LIGHTING ASSEMBLY

The present invention relates to electric lighting assemblies and more particularly to lighting assemblies adapted to operate using extra low voltage.

As used in the specification, extra low voltage means voltages up to 24 volts as defined by the Standard Association of Australia in Standard No. 3000.

In the lighting art, there has been known the use of so called track lighting as a means of illumination of particular utility where objects to be illuminated may be moved within a room thereby requiring the repositioning of the source of the illumination. Another use of track lighting is in the situation where objects are illuminated for display purposes and there is a requirement that the source of illumination be actively positioned so as to illuminate each object individually. Moreover, track lighting allows for the disposition of a plurality of lamps and a single track thereby allowing a plurality of objects to be illuminated.

In essence, the utility of track lighting stems from the ability to be able to move individual lamps in their respective lamp holders along the track and to then to position each lamp individually to illuminate desired areas or objects.

It will be appreciated however that track lights are adapted for operation using electrical mains voltage, which in Austrailia is nominally 240 volts. As a result of the use of such high voltages, it is essential that a track light design meets appropriate standards of wiring and installation to ensure that it is safe in operation. This of course places considerable restraint on the design of such lighting systems, particularly in the need for adequate insulation from any electrically conducting part.

The safety aspects of operation using mains voltages has been recognised in the art and accordingly, lighting assemblies are known in the art that have been designed to operate using voltages considerably lower than mains voltage, thereby minimizing any electrical danger during operation.

Further, there is known such an assembly wherein lamps in the assembly may be in relatively crude fashion positioned to illuminate objects individually. The essential parts of this assembly are a pair of parallel spaced apart elongate conductors, one end of each conductor being mounted in one wall and the other end of each conductor in an opposing wall, each conductor being connected to a source of extra low voltage, a pair of uninsulated conductive wires, a portion of each wire being disposed over a corresponding conductor and a lamp holder having means whereby one end of each wire is an electrical connection with a socket within the lamp holder, adapted to accept the lamp and wherein the opposing end of each said wire is counter-weighted with respect to the lamp holder. In this assembly, positioning of the lamp with respect to an object to be illuminated is affected by positioning the wires along the conductors until the lamp is in the same or a close vertical plane of the object. By raising or lowering the wires as appropriate, the lamp is positioned so as to illuminate the desired object.

From the foregoing it will be evident that one difficulty inherent in such an assembly is that since the lamp hangs from the wires, the variation in the positioning of the lamp in a direction traverse the access of the conductors is not possible owing to the flexible nature of the wires. In such an assembly, this may only be overcome by having the lamp holder connected to the wire so as to be displaced fixedly in the appropriate transverse direction.

The present invention has recognised this and other disadvantages inherent in prior art devices and recognising the increasing need for extra low voltage lighting assemblies for use in displays and other commercial areas now seeks to provide an alternative lighting assembly wherein the lamp in the assembly may be quickly, easily and accurately positioned to illuminate a desired object.

Accordingly the present invention consists in a lighting assembly for operation at no more than about 24 volts comprising a lamp holder, a pair of rigid electrically conductive arms, each arm having a lower end and an upper end, said lower ends being opposingly mounted on the lamp holder, in electrical contact with a lamp socket disposed within the holder, in a manner such that a lamp mounted in said holder may be positioned axially about thereof, each upper end having means to permit independent movement along one of a pair of spaced apart elongate electrical conductors and to be fixed in place to form electric contact therewith, each said conductor having means to connect to a source of electrical current, and wherein movement of said arms along said conductors permits a lamp mounted in said holder to be positioned transversely with respect to the axis lying through the lower ends and longitudinally with respect to the conductor.

In use, the conductors will generally be mounted with each end on an opposing wall. For such use, the conductors may be appropriately conductive metal rods of sufficient rigidity so as to be able to support the weight of the lamp holder and arms in a particular assembly without bending or flexing unduly. The rods must also be of sufficient cross sectional area so as to be able to carry the current used in an assembly. Suitably, the rods may be formed from such metals as copper, brass or aluminium. Particularly preferred is aluminium owing to its strength, low weight and relatively high electrical conductivity.

It is also within the scope of the invention that the conductors are suitable electrically conducting wires, capable of being appropriately tensioned between two opposing walls so as to support the weight of the lamp holders and arms without unduly flexing or bending.

When the conductors are rods, they may also be mounted from for example a ceiling. This may be achieved by means that support each of the rods, preferably by connecting to or near the ends of each rod, such that the rods are kept spaced apart by appropriate insulation. In one such embodiment, the source of electric current may be connected to each rod by means of wires disposed along the support means. It will also be evident that the extended movement of the arms along such rods will be limited by the position of the point of connection of the support means. The support means may therefore be constituted by a single wire connected to each end of the conductors thereby providing the maximum extent of movement along each conductor.

In another embodiment, the support means comprises a pair of rods, having upper ends adapted to connect to an appropriate source of electric current and an insulating member having a bridge portion and receiving portions disposed either side of the bridge, each receiving portion having a vertically extending recess adapted to receive one of said rods and a pair of horizontally extending recesses disposed about the vertical recess and adapted to receive an elongate conductor. In this embodiment, an elongate conductor may be brought into electrical contact with a rod by sliding a conducting plate into a horizontal recess in a manner such that the plate contacts the rod and conductor. Another elongate conductor may then be placed into the other horizontal recess and similarly brought into electrical contact with a rod. Alternatively, an insulating plate may be used to electrically isolate the second elongate conductor from that rod. The advantage of this arrangement is that in use, a plurality of support members may be used to provide separate electrical control for adjacent elongate conductors and the respective lighting assemblies mounted thereon.

The aforementioned embodiment may be varied where it is desired to mount elongate members closer to the ceiling. In this variation, power cable, with appropriate termination, may be passed directly into the vertically extending recesses and by mounting the insulating member directly onto the ceiling, the power cable will be effectively concealed.

The source of electric current will generally be a transformer operating from the mains voltage, capable of providing an appropriate voltage and current for a particular assembly. Thus in a typical assembly, a transformer may when connected to 240 volts produce 12 volts at up to 80 amps thereby allowing 17 50W lamps to be operated from a single assembly. Connection of a transformer to the conductors may be affected by a variety of means known in the art, including appropriately matched plugs and sockets.

It is essential that the arms are held in electrical contact on their upper ends with the conductor. In one embodiment, this may be readily achieved by forming the arms from uninsulated metal rods, wherein a connecting means is provided on each of the upper ends. Thus, in such an embodiment, it is unnecessary to insulate the arms as the use of extra low voltage is not sufficient to cause electrocution or any injury should the rods be contacted inadverently.

However, in some embodiments, it may be desirable to provide some adornment on the arms for aesthetic reasons, thereby resulting in the indirect insulation of said arms.

In those embodiments wherein the arms are rods, the connection means may comprise a U shaped member, the open portion of which is adpated to be brought into co-operation with a conductor and a nut adapted to be screwed onto a thread disposed along the U shaped member to thereby hold a conductor in contact with the upper end of an arm. Suitably, the U shaped member may be provided with an internally threaded portion that allows it to be held on an appropriately threaded portion of an upper end.

It should be noted that in this embodiment, the depth of the opening in the U shaped portion will determine the extent that the lamp holder may be transversely directed.

If the arms are constituted by rods, the formation of a suitable connection at a lower end thereof is facilitated. Thus, by forming a bend in the rod at the lower end, so that the portion constituting the lower end is orthogonal to the remaining portion of the rod, the lower end may be readily connected to a lamp holder by providing a pair of holes on opposing sides, each adapted to frictionally accept a lower end. Each lower end may then be brought into electrical contact with the lamp socket disposed in the holder. By this arrangement, the lamp holder is positionable about the axis formed by the opposed lower end.

Naturally, the length of the arms may be selected in accordance with the height of the conductors and the position of an object to be illuminated in relation thereto.

In one embodiment, wherein the arms are rods, the lower ends may be brought into electrical contact with the socket by providing a slot between the body of the lamp holder and the socket whereby a lower end is retained in the slot by means of a screw that passes through said body to force the lower end into electrical contact with the socket. One advantage flowing from the use of this embodiment is that the force exerted by the screws on the lower ends provides restriction on the axial movement of the lamp holder so that once positioned, the lamp holder remains substantially positionally fixed.

The lamp holder may be any of many such lamp holders known in the art and formed from a variety of materials. However, in those embodiments wherein halogen dichroic lamps are used, it is important to provide ventilation behind the lamp in the lamp holder to permit heat generated to be adequately dissipated. The reason for this is that such lamps direct about 80% of the heat generated towards the rear.

Similarly, the sockets used may be selected from a wide range of lamp sockets known in the art, provided they are capable of forming a suitable electrical contact with the arms.

In use, the lamp holder may be mounted on the lower ends of the arms and the upper ends of the arms brought into co-operation with the conductors. The lamp holder then hangs by the arms from the conductors. Movement of the upper ends of the arms along the conductors permits the lamp holder to be positioned longitudinally approximately in relation to an object to be illuminated. Then, by moving each of the upper ends of the arms in opposing directions along their respective conductors, the position of the lamp holder and hence the lamp may be varied transversely whilst movement about the axis of the lower ends enables the positioning of the lamp in a vertical plane. Thus, by being able to accurately direct illumination for such a lamp, objects may readily be individually lit.

From the foregoing, it will be appreciated by those skilled in the art that the present invention has particular utility in for example illuminating paintings displayed in a gallery. Moreover, when dichroic halogen lamps are used, the amount of light in relation to heat is high, thereby ensuring that the illuminated object does not become heat damaged.

Hereinafter by way of example there is described one embodiment of the present invention in which.

Figure 1:
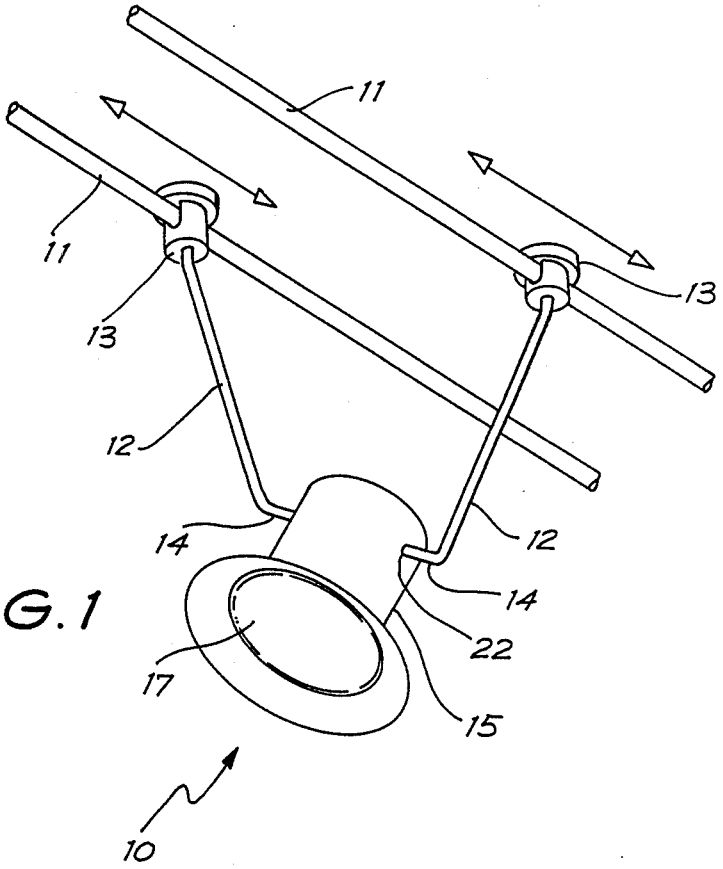
FIG. 1 is a perspective view of a lighting assembly.

The lighting assembly 10 includes a pair of spaced apart ¼ inch diameter aluminium rods 11 disposed between opposing walls, not shown. Connected, not shown, to one end of each of the rods 11 is the output of a 12 volt transformer, capable of providing a current of up to 80 amps.

A pair of arms 12 each have a threaded U shaped connector 13 on an upper end, and a lower end 14 connected to a lamp holder 15. The lamp holder 15 is formed from plastics materials.

A 50 W dichroic halogen lamp 17 is mounted in a socket 18 in a holder 15.

Figure 2:
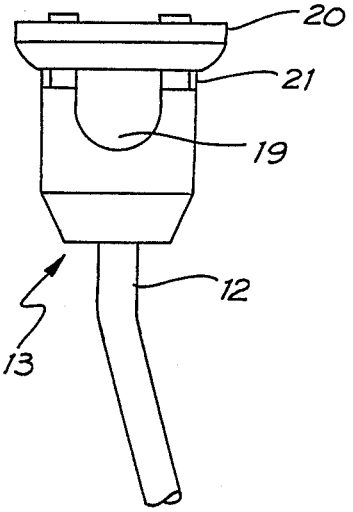
FIG. 2 is an exploded side elevational view of a connection means.

As is best seen in FIG. 2, connector 13 has a U shaped opening 19 adapted to form an electrical connection with rod 11 and be held in place thereon by a nut 20 disposed on the threaded portion 21. In this embodiment the connector 13 is internally threaded so as to permit it to be screwed onto the threaded upper end (not shown) of arms 12.

The connector 13 and arms 12 are formed of brass rod.

Figure 3:
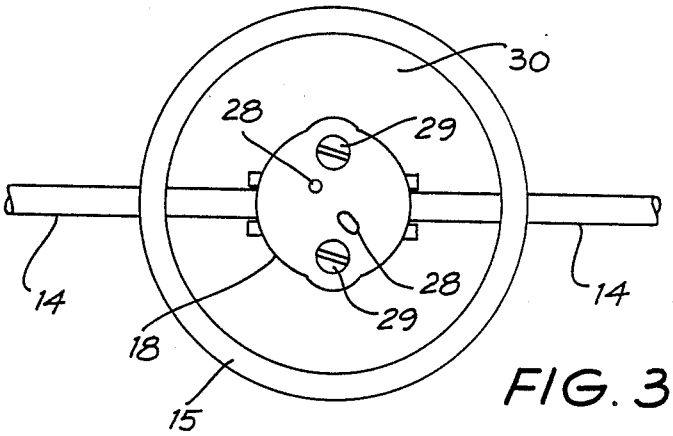
FIG. 3 is a front elevational view of a lamp holder.
Figure 4:
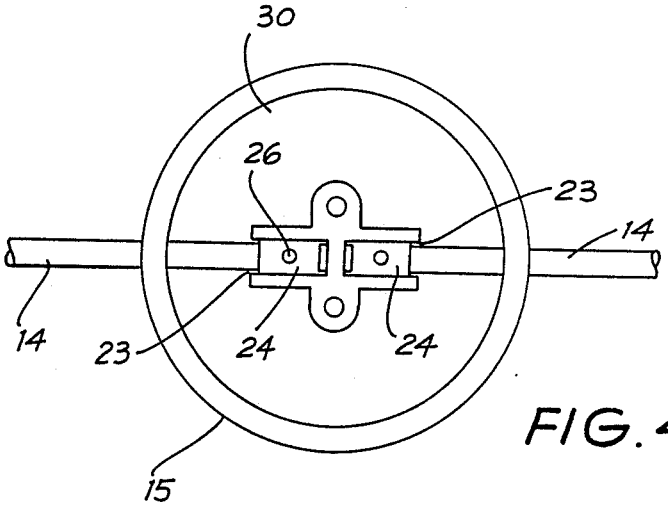
FIG. 4 is a front elevational view of a lamp holder with the socket removed.

The lower ends 14 of arms 12 pass through holes 22 in lamp holder 15 and into slots 23. Above each slot 23 there is disposed a metal block 24, having raised portions 26 adapted to co-operate with socket 18 so as to form an electrical contact between lower ends 14 and recesses 28 into which the pins of lamp 17 are plugged. As shown in FIG. 3, socket 18 is held in place in the holder 15 by screws 29. When socket 18 is retained in place in the holder 15, blocks 24 are forced into electrical contact with lower ends 14 by way of screws (not shown) that pass through the back portion 30 to bear on a portion of ends 14 disposed in slots 23. The force exerted by the screws enables the lamp holder 15 to be held in place when pivoted about the axis defined by the lower ends 14.

In use, connectors 13 are each brought into co-operation with rods 11. The nuts 20 are then placed over the ends of the connectors to hold the arms 12 and lamp holders 15 in place. Movement of the arms 12 in the same direction permits the lamp holder to be positioned longitudinally with respect to the conductors whilst movement of the arms in opposite directions, as shown by the arrow in FIG. 1, results in the transverse movement of the lamp holder 15 in the direction of the arrows shown. The lamp holder 15 may also be pivoted about the axis defined by the lower ends 14. Thus the lamp may be positioned accurately with respect to an object to be illuminated.

I claim:

1. A lighting assembly for operation at no more than about 24 volts comprising a lamp holder, a pair of rigid electrically conductive arms, each arm having a lower end and an upper end, said lower ends being opposingly mounted on the lamp holder in electrical contact with a lamp socket disposed within the holder, in a manner such that the lamp mounted in said holder may be positioned axially about thereof, each upper end having means to permit independent movement along one of a pair of spaced apart elongate electrical conductors and to be fixed in place to form electrical contact therewith, each said conductor having means to connect to a source of electric current, and wherein movement of said amrms along said conductors permits a lamp mounted in said holder to be positioned transversely with respect to the axis lying through the lower ends and longitudinally with respect to the conductors.

2. A lighting assembly as in claim 1, wherein the conductors are rods disposed in parallel array between two opposing walls.

3. A lighting assembly as in claim 2, wherein each of the upper ends has disposed thereon a U shaped member, the opening of which is adapted to co-operate with the conductor and wherein a threaded portion of the U shaped member accepts a nut to secure said upper end on each conductor.

4. A lighting assembly as in claim 3, wherein the U shaped member is affixed to an upper end by a thread formed on a portion thereof and an internally threaded portion in said member.

5. A lighting assembly as in claim 4, wherein electrical contact is maintained between the socket and the lower end by disposing said lower end in a slot formed between the body of the lamp holder and the socket, and wherein a screw passed through said body acts to force the lower end into electrical contact with the socket and retain said lower end therein.

6. A lighting assembly as in claim 5, wherein the conductors are aluminium or brass rods.

* * * * *